United States Patent [19]

Lee et al.

[11] Patent Number: 4,706,765

[45] Date of Patent: Nov. 17, 1987

[54] DRILL BIT ASSEMBLY

[75] Inventors: Ernie J. Lee, Lafayette; William L. Thornton, Carencro, both of La.

[73] Assignee: Four E Inc., Lafayette, La.

[21] Appl. No.: 895,669

[22] Filed: Aug. 11, 1986

[51] Int. Cl.[4] ..... E21B 10/26

[52] U.S. Cl. ..... 175/334; 175/339; 175/373; 175/391

[58] Field of Search ..... 175/334, 339, 351, 353, 175/355, 373, 376, 385, 391, 398, 371, 372, 400

[56] References Cited

U.S. PATENT DOCUMENTS

| | | | |
|---|---|---|---|
| 1,046,615 | 12/1912 | Litaker . | |
| 1,174,575 | 3/1916 | Hughes . | |
| 1,474,633 | 11/1923 | Hughes . | |
| 1,747,908 | 2/1930 | Seifert . | |
| 1,747,909 | 2/1930 | Seifert | 175/351 |
| 1,812,475 | 6/1931 | Gildersleeve et al. . | |
| 1,823,567 | 9/1931 | Martin . | |
| 1,826,059 | 10/1931 | Dunn et al. | 175/362 |
| 1,859,978 | 5/1932 | Metzger | 175/373 |
| 2,174,587 | 10/1939 | Love | 175/371 |
| 2,310,289 | 2/1943 | Hokanson | 175/373 |
| 2,637,529 | 5/1953 | Howell | 175/351 |
| 3,207,241 | 9/1965 | Neilson | 175/376 |
| 3,329,222 | 7/1967 | Neilson | 175/376 |
| 3,358,782 | 12/1967 | Bechem | 175/373 |
| 3,397,928 | 8/1968 | Galle . | |
| 4,031,974 | 6/1977 | Peterson | 175/334 |
| 4,209,890 | 7/1980 | Koskie, Jr. | 175/371 |

FOREIGN PATENT DOCUMENTS

| | | | |
|---|---|---|---|
| 1186427 | 2/1965 | Fed. Rep. of Germany | 175/391 |
| 1223779 | 9/1966 | Fed. Rep. of Germany | 175/376 |

*Primary Examiner*—Stephen J. Novosad
*Assistant Examiner*—Bruce M. Kisliuk
*Attorney, Agent, or Firm*—Drude Faulconer

[57] ABSTRACT

A drill bit assembly comprised of a pilot bit and a plurality of add-on reamer sections which are sized to progressively increase the diameter of the hole in measured increments. Both the pilot bit and the reamer sections have two cutter elements which take advantage of the bi-center concept and both use knife edged cutters instead of teeth to drill the hole.

28 Claims, 10 Drawing Figures

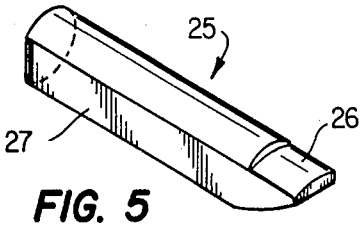
FIG. 5
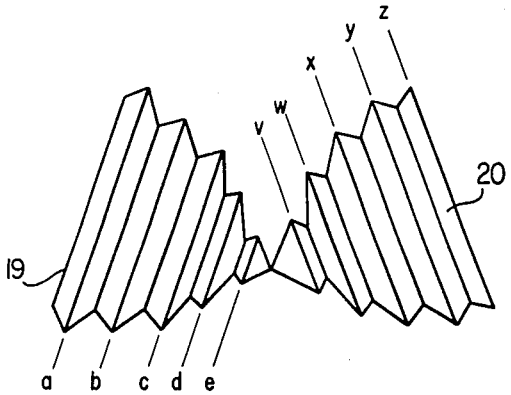
FIG. 10
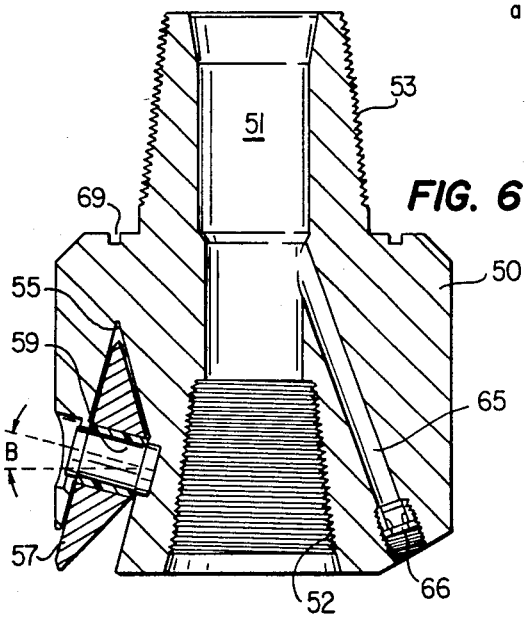
FIG. 6
FIG. 8
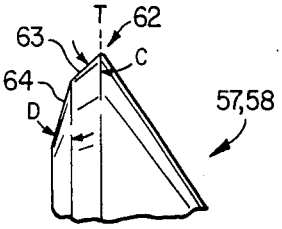
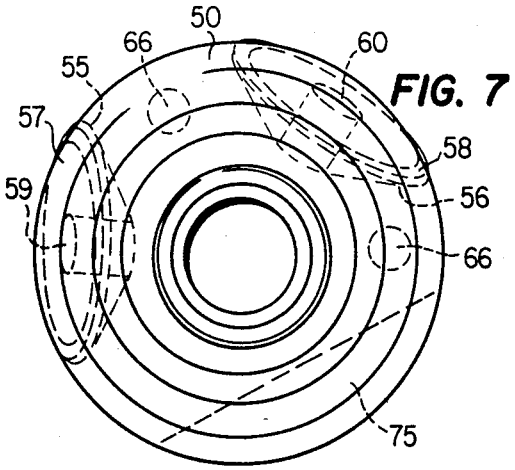
FIG. 7
FIG. 9
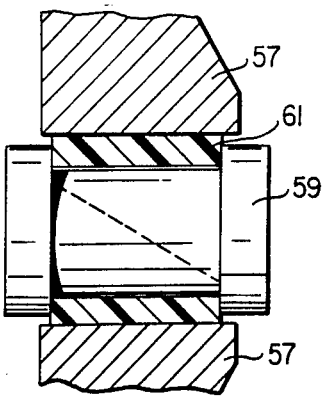

DRILL BIT ASSEMBLY

DESCRIPTION

1. Technical Field

The present invention relates to a drill bit and more particularly relates to a drill bit assembly which is comprised of a pilot bit and a plurality of reamer sections which can be added as needed to drill holes of different diameters.

2. Background Act

A major consideration in the economics of drilling any oil or gas well is the costs of the drill bits required and the expense in downtime and labor required to change or replace the bits as drilling proceeds. For example, in some wells, several different types of bits (e.g. insert, diamond, P.D.C., mill cutters, strata bit types, etc.) may be needed during the drilling of a single well. To maintain such a supply of bits available at the rig site and to make the necessary "trips" of the drill string to exchange or replace the various bits is obviously time-consuming and expensive. Further, many of these bits require large weights-on-bit (WOB) while others need to be rotated at high revolutions-per-minute (RPMS) to drill efficiently thereby increasing maintenance problems and hence, the expense of drilling the well.

Also, in drilling a typical well, a large diameter bit is routinely used to drill the upper portion of the hole to a first depth where a first string of casing (e.g. surface casing) is to be set. A smaller diameter bit is then used to drill to a depth where a second casing string is to be set, and so on. Again, this requires a number of different sized bits to be available and in some cases requires several trips to reach a particular casing point in the hole.

Therefore, a need exists for a single bit assembly at a well site that is comparable in performance to a wide variety of different types of drill bits and one which is easily adapted to drill whatever diameter of hole required.

DISCLOSURE OF THE INVENTION

The present invention provides a drill bit assembly that is comprised of a two cone, bi-center pilot bit and one or more add-on reamer sections which are sized to progressively increase the diameter of the hole, in relative small increments, from that of the bit to the final diameter desired. The present drill bit assembly is designed to "finesse" a hole in the earth rather than tear a hole in the earth by brute strength and high horsepower.

The pilot bit of the present assembly is comprised of a body having two legs which are spaced 120° apart. Each leg has a journal pin thereon on which a cutter cone is rotatably mounted by means of disk bearings. An O-ring on the cone allows a lubricant under pressure to be supplied to the bearings to substantially extend the bearing life. Each cone has a plurality of smooth, circular cutting knife edges on the surface thereof which are spaced so that the edges on one cone will track between the paths defined by the edges on the other cone so that 360° of the bottom is cut by the edges on the cones.

The cones are slanted downward and inward at an angle of 20° to the horizontal and their inner tips lie on the centerline of the bit body with no offset as normally found in prior art bits. The cones are true rolling and, as stated above, designed to leave no uncut bottom areas.

Since disk cutting edges are used on the cones instead of teeth, buttons, etc., as normally used in prior art bits, the cutting edges will be in tension at all times during drilling in that there is no load transfer as the disk rotates and accordingly the bearing life is even further increased, e.g. up to 240 hours or more. Jet nozzles in the body supply pressurized fluid to the leading edge of the legs to clean the cones and aid in drilling.

The reamer sections are of identical construction except for the size which increases with the diameter of the hole to be drilled. Each reamer has a body that has two recesses therein in which a disk cutter is rotatably mounted on a shaft. Each disk cutter has a special knife edge which allows the cutter to easily slice into and break up the formation being drilled. Jet nozzle means in the body supply pressurized fluids to the leading edge of the cutters.

Both the pilot bit and each reamer section have two cutter elements which take advantage of the bi-center concept which in most cases allows the present bit assembly to be used to drill to each casing point within a well without a trip being required to replace the bit.

BRIEF DESCRIPTION OF THE DRAWINGS

The actual construction, operation, and apparent advantages of the present invention will be better understood by referring to the drawings in which like numerals identify like parts and in which:

FIG. 5 is a perspective of the bearing retaining plug of the present invention;

FIG. 6 is a sectional view of the reamer section of FIG. 1;

FIG. 7 is a plan view of the reamer section of FIG. 6;

FIG. 8 is an enlarged view of the cutting edge of the reamer disk of FIG. 7;

FIG. 9 is an enlarged view of the sleeve bearing for the reamer disk of FIG. 7; and FIG. 10 is a perspective view of the two cones of the pilot bit of FIG. 1.

BEST MODE FOR CARRYING OUT THE INVENTION

Figure 1:
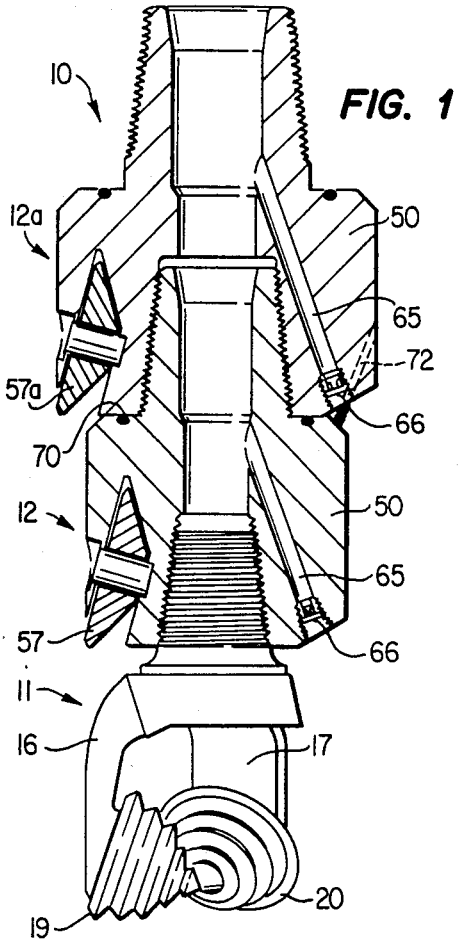
FIG. 1 is a cross-sectional view of the drill bit assembly of the present invention.

Referring more particularly to the drawings, FIG. 1 discloses drill bit assembly 10 of the present invention. Assembly 10 is comprised of pilot drill bit 11 and a plurality of reamer bit sections 12, **12*a*** (only two shown) which are adapted to be coupled thereto to provide a multi-purpose drill bit capable of drilling various diameter holes.

Figure 2:
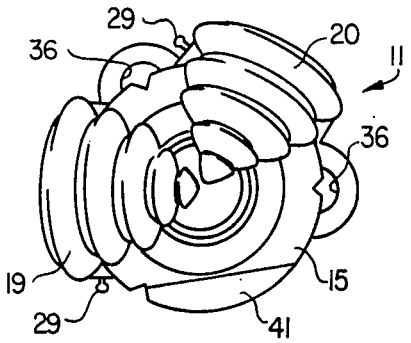
FIG. 2 is an enlarged bottom view taken along line 2—2 of FIG. 1.
Figure 3:
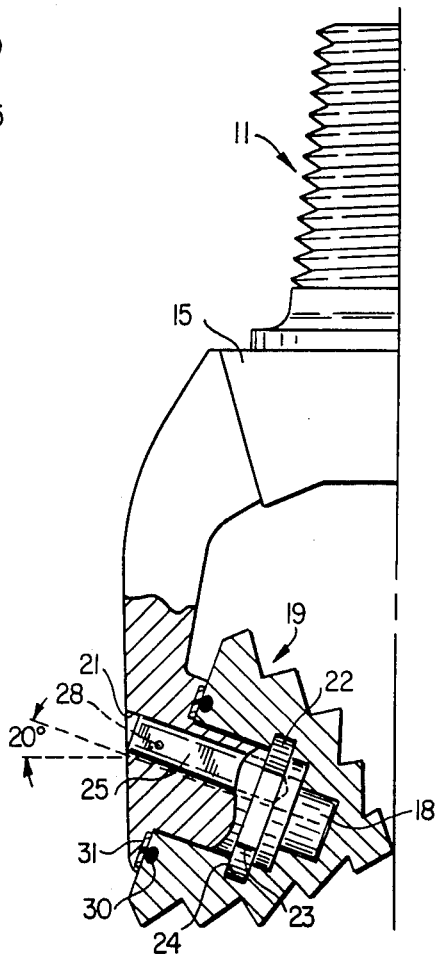
FIG. 3 is a sectional view of one-half of the pilot bit of FIG. 1.

The details of pilot bit 10 are shown in FIGS. 2 and 3. Bit 10 is comprised of body 15 which has two legs 16, 17 which, in turn, are radially spaced from each other by 120°. Each leg 16, 17 has an integral journal pin 18 (only one shown in FIG. 3) which extends downwardly and inwardly at an angle to the horizontal equal to 20°. Knife-edged or disk roller cutter cones 19, 20 are rotatably mounted on pins 18 on legs 16, 17, respectively, by means of cylindrical disk bearings 22. As will be understood in the art, each leg 16, 17 has an opening 21 through which bearings 22 are loaded into cooperating grooves 23, 24 on pin 18 and cutter cone 19, respectively, to thereby hold the respective cone on the pin. Plug 25 (FIGS. 3 and 5) is inserted and welded or otherwised secured into opening 21 to lock bearings 22 in place. Plug 25 has a recess 26 at its inner end to provide a part of the bearing race and is flatten on one side 27 to allow grease or other lubricant to flow from passage 28 (FIG. 3) in legs 16, 17 to bearings 22. Grease fittings 29 (FIG. 2) closes the passages 28 in legs 16, 17, respectively, and provide a means for loading the bearing lubricant (e.g. light commercial grease base with added bronze, graphite, zinc, etc.) into passages 28.

Each cone (only 19 is shown in FIG. 3) has an annular groove on its inner surface, in which an O-ring seal 30 is mounted to rotate with the respective cone. Seal 30 acts to keep drilling mud or other abrasives from bearings 22 and allows the lubricant to be loaded under pressure, e.g. 1000 psi. To extend the life of seal 30 and to reduce friction between seal 30 and leg 16, 17, an annular bearing surface, e.g. Teflon washer 31, is mounted on the inside of legs 16, 17, respectively, adjacent seal 30 and is adapted to provide a low resistance annular surface on which seal 30 will ride during rotation of cone 19, 20.

Figure 4:
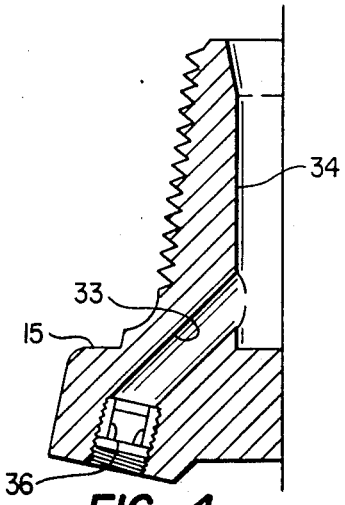
FIG. 4 is a sectional view of the jet nozzle passages in the bit of FIG. 1.

Body 15 has two fluid passages 33 therein (only one shown in FIG. 4) which are adapted to supply drilling fluid from the bore 34 of body 15 to individual jet nozzles 36. As shown in FIG. 2, nozzles 36 are positioned adjacent the leading edge of respective legs 16, 17 when viewed in the intended direction of rotation of bit 11 (heavy arrowed line in FIG. 2). Pressurized fluid from nozzles 36 impinge downward onto the bottom of the hole to aid in drilling and to keep the cutting edges on the cones clean during drilling operations.

As set forth above, pins 18 on legs 16, 17 are radially set apart by 120° and are slanted downwardly at 20° so that when cones 19, 20 are in place on legs 16, 17, their inner tips will lie on the centerline 40 (FIG. 3) of the bit body 15. That is, there is no radial offset between the tips of the cones as is the case in known prior art bits of this general type. This positioning provides a two cone, bi-center bit which allows bit 11 to cut a full gage hole (e.g. 6½ inch) with a much smaller bit body diameter than before possible which is important in reducing swab and surge pressures in the hole.

Cones 16 and 17 are true rolling and designed to leave no uncut area on the bottom of the hole being drilled. Each cone utilizes disk or knife-edges as opposed to teeth, buttons, inserts, etc., which are normally used in known, roller cone bits. As best seen in FIG. 10, both cones 19, 20 have a plurality of integral disks (a, b, c, d, e and v, w, x, y, z, respectively), thereon which are spaced so that a disk on one cone (e.g. a on cone 19) will cut that portion on the bottom which will be left between two disks on the other cone (e.g. y and z on cone 20) and a disk on the other cone (e.g. x on cone 20) will cut that bottom portion left between two disks on said one cone (e.g. b and c on cone 19). That is, a disk on one cone will track between the paths formed by two disks on the other cone to insure all 360° of a hole will be cut by bit 11.

The disk cutter cones of bit 11 will drill a convex hole and the disks will be tension at all times when bit 11 is on the bottom. Since there is no load transfer between teeth, buttons, on cone 19, 20 etc., as is the case in prior art cone bits, the expected life of bearings 22 is substantially increased. The disks or knife edge cutter cones allow bit 11 to drill with lighter weight-on-bit and at slower rpms that is practical with most known conventional cone bits.

The lower surface of bit body 15 away from cones 19, 20 is beveled at 41 to reduce the bottom surface area of body 15 thereby reducing the swab and surge pressures created when the lower surface acts as a piston when the bit assembly is moved up and down in the drilling fluid in the hole.

Bit 11 is primarily to be used as a pilot bit to overcome the compressive strength of the formation being drilled. For typical drilling operations, the bit size will be from 6½ inch to 6¾ inch depending on the hole size desired. This one bit size will allow any size hole to be drilled by merely adding the appropriate reamer sections **12, 12*a* (FIG. 1) to bit 11**.

Referring now to FIGS. 6 and 7, reamer section 12 is comprised of a body 50 having a bore 51 therethrough. Body 50 has an internally threaded box 52 and an externally threaded pin 53 for threadingly connecting reamer section 12 to bit 11 and to a second reamer section **12*a* (FIG. 1). It will be understood that all reamer sections are of the same basic construction and will differ only in size (e.g. diameter of body 50). The length of reamer bodies 12** will normally range from 6.5 to 7.5 inches while the actual diameter will depend on the size of the hole to be drilled.

Body 50 is formed with two recesses 55, 56 which are radially spaced from each other by 120°. Disk cutters 57, 58 (e.g. 4 to 8 inches in diameter) are mounted in recesses 55, 56, respectively, on fixed shafts 59, 60, respectively, which, in turn, slant inward and downward at an angle B equal to 15°. A friction resistant sleeve bearing 61 (e.g. Teflon) is positioned between a cutter and its respective shaft (FIG. 9) to allow easy rotation of the cutters on the shaft. Disk cutters 57, 58 are made of an abrasive resistant material, e.g. tungsten carbide, ceramic, etc., and have a specially constructed cutting edge 62 (FIG. 8). The outer side of edge 62 is double canted having a first portion 63 inclined at a first angle C equal to 45° and a second portion 64 inclined at a second angle D equal to 15° when measured with respect to the diameter T of the disk.

This cutting edge 62 configuration allows disk cutters 57, 58 to slice into and break off the formation with reduced resistance as drilling proceeds. Body 50 has two fluid passages 65 (only one shown in FIG. 6) which communicate between bore 51 and jet nozzles 66 which, in turn, open through the lower surface of body 50 at points adjacent to leading edges of disks 57, 58 as reamer section 12 moves in its intended direction of rotation. The upper surface 68 of body 50 has an annular groove 69 therein adapted to receive an O-ring 70 which seals between respective reamer sections and also provides addition friction between sections to prevent accidential unthreading of sections during any reverse rotation that may be required during drilling operations. As further protection against accidential unthreading in the hole, a passage 72 (FIG. 1) is provided through body 50 of section **12*a* through which a set screw 71 is inserted to extend into the upper surface of the body 50 of section 12** to prevent rotation therebetween.

The lower surface of body 50 away from disks 57, 58 is leveled at 75 to reduce the lower surface area of body 50 to thereby further reduce the swap and surge pressures caused by raising and lowering bit assembly 10 in a liquid-filled well.

As stated before, the diameter of body 50 will vary depending on the diameter of the hole to be drilled. Preferably, each reamer section 12, 12*a*, etc. will increase the diameter of the hole by 2 inch increments. That is, if bit 11 cuts a $6\frac{1}{2}$ inch hole then bit 11 with reamer section 12 will cut a $8\frac{1}{2}$ inch hole and with reamer sections 12 and 12*a* will cut a $10\frac{1}{2}$ inch hole and so on.

In aligning bit 11 and reamer sections 12, 12*a* etc., it is preferred that all disks 57, 58 on the various reamer sections be respectively vertically aligned, i.e. cone 19, cutter 57, cutter 57*a* (FIG. 1) will be vertically aligned and cone 20, cutter 58, cutter 58*a* (not shown) will be vertically aligned.

What is claimed is:

1. A drill bit assembly comprising:

a pilot bit comprising:

a bit body having two legs radially positioned 120° apart thereon and depending from the lower surface thereof, said lower surface of said bit body away from said legs being beveled to reduce the effective area of said lower surface;

a cutter cone rotatably mounted on each of said legs and extending inward and downward whereby the inner tip of each cone lies on the centerline of said body;

each of said cones having a plurality of smooth circular cutting knife edges spaced along the surface thereof whereby said cutting edges on one of said cones will track between the pathes defined by said cutting edges on the other of said cones when said bit is rotated during drilling operation to thereby cut all of the bottom area of the hole to be drilled;

a first reamer section comprising:

a reamer body connected to the upper end of said pilot bit;

two disk cutters; and means for rotatable mounting said disk cutters on said body at points radially spaced 120° from each other and positioned to drill a hole having a diameter larger than that of the hole drilled by said pilot bit.

2. The drill bit assembly of claim 1 including:

a second reamer section connected to the upper end of said first reamer section and adapted to drill a hole having a diameter greater than that drilled by said first reamer section.

3. The drill bit assembly of claim 1 including:

a plurality of additional reamer sections connected to the upper end of said first reamer section and to each other; each of said reamer sections adapted to drill a hole having a diameter greater than that of the hole drilled by the reamer section immediately below.

4. The drill bit assembly of claim 1 wherein said means for mounting said disk cutters comprises:

a pair of shafts, each shaft affixed to said reamer body at an angle with respect to the horizontal and having one of said disk cutters rotatably mounted thereon.

5. The drill bit assembly of claim 4 wherein said angle is about 15°.

6. The drill bit assembly of claim 5 including:

jet nozzle means in said bit body adapted for supplying fluid under pressure to the leading edge of each of said cones.

7. The drill bit assembly of claim 6 including:

jet nozzle means in said reamer body adapted for supplying fluid under pressure to the leading edge of each of said disk cutters.

8. The drill bit assembly of claim 1 wherein the lower surface of said reamer section away from said disk cutters in beveled to reduce the effective area of said lower surface.

9. The drill bit assembly of claim 8 wherein each of said disk cutters is vertically aligned with a respective cone on said bit.

10. A two-cone drill bit comprising:

a body having two legs radially positioned 120° apart thereon and depending from the lower surface thereof; said lower surface of said bit body away from said legs being beveled to reduce the effective area of said lower surface;

a journal pin on each leg extending inward and downward toward the centerline of said body;

two cutter cones;

means for rotatably mounting said cones on respective said journal pins whereby the inner tips of said cones lie on said centerline of said body; and wherein each of said cones having a plurality of smooth circular, cutting knife edges spaced along the surface thereof whereby said cutting edges on one of the said cones will track between the pathes defined by said cutting edges on the other of said cones when said bit is rotated during drilling operation to thereby cut all of the bottom area of the hole to be drilled.

11. The drill bit of claim 10 wherein each of said journal pins extend inward and downward at an angle equal to about 20° from the horizontal.

12. The drill bit of claim 11 wherein said means for mounting said cones comprises:

cylindrical bearings between said cone and said journal pin.

13. The drill bit of claim 12 including:

an O-ring seal mounted in an annular groove on the inner surface of each of said cones, said O-ring adapted to rotate with its respective cone and form a seal between said cone and its respective leg on said body.

14. The drill bit of claim 13 including:

an annular bearing surface mounted in each of said leg adjacent said O-ring on said respective cone and adapted to provide a bearing surface for said O-ring.

15. The drill bit of claim 14 wherein said bearing surface comprises:

a Teflon washer.

16. The drill bit of claim 15 including:

jet nozzle means in said body for providing fluid under pressure to clean said cutting edges on said cones.

17. The drill bit of claim 16 wherein said jet nozzle means comprises:

a jet nozzle positioned at the leading edge of each of said legs of said body.

18. The drill bit of claim 17 including:

means for supplying lubricant to said bearings.

19. The drill bit of claim 18 wherein the lower surface of said body away from said cones is beveled to reduce the effective area of said lower surface.

20. A reamer section comprising:

a reamer body having an externally threaded pin member and an internally threaded box member;

said reamer body having two recesses therein which are radially spaced 120° apart, said reamer body having a lower surface which is beveled away from disk cutters to reduce the effective area of said lower surface;

two disk cutters, each disk cutter having a smooth, knife cutting edge having an outer side, and means for rotatably mounting one of said disk cutter in each of said recesses.

21. The reamer section of claim 20 wherein said outer side of the cutting edge of each of said disk cutter has a first portion which tapers downward from said edge at a first angle with respect to the diameter of said disk and a second portion which tapers downward from said first portion at a second angle which is less than said first angle.

22. The reamer section of claim 21 wherein said first angle is about 45° and said second angle is about 15°.

23. The reamer section of claim 22 including:

jet nozzle means in said reamer body adapted to supply fluid to the leading edge of each of said disk cutter.

24. The reamer section of claim 23 wherein said means for mounting said disk cutter comprises:

a shaft extending down and through said recess at an angle to the horizontal and affixed to said body; said disk cutter being rotatably mounted on said shaft.

25. The reamer section of claim 24 wherein said angle of said shaft is about 15°.

26. The reamer section of claim 25 wherein said body has an upper surface and a lower surface and including:

an O-ring seal mounted in an annular groove in said upper surface of said body and is adapted to seal with the lower surface of a second reamer section when a box member of the second reamer section is connected to said pin member of said reamer section.

27. The reamer section of claim 26 including:

a bearing sleeve positioned between said shaft and said disk cutter.

28. The reamer section of claim 27 including:

a set screw through said lower surface of said reamer body.

* * * * *